United States Patent [19]

Stahlecker

[11] Patent Number: 4,584,832

[45] Date of Patent: Apr. 29, 1986

[54] FIBER FEED CHANNEL ARRANGEMENT FOR OPEN-END FRICTION SPINNING

[75] Inventor: Fritz Stahlecker, Josef-Neidhart-Strasse 18, 7347 Bad Uberkingen, Fed. Rep. of Germany

[73] Assignees: Hans Stahlecker; Fritz Stahlecker, both of Fed. Rep. of Germany

[21] Appl. No.: 657,875

[22] Filed: Oct. 4, 1984

[30] Foreign Application Priority Data

Oct. 7, 1983 [DE] Fed. Rep. of Germany ..... 3336547

[51] Int. Cl.[4] ..... D01H 7/892

[52] U.S. Cl. ..... 57/401; 57/407; 57/413

[58] Field of Search ..... 57/406, 407, 413, 401, 57/408

[56] References Cited

U.S. PATENT DOCUMENTS

| | | | |
|---|---|---|---|
| 3,685,272 | 8/1972 | Greenwood et al. | 57/406 |
| 3,901,013 | 8/1975 | Sharychenkov | 57/413 |
| 4,014,162 | 3/1977 | Stahlecker | 57/413 |
| 4,202,163 | 5/1980 | Turk et al. | 57/327 X |
| 4,315,398 | 2/1982 | Parker et al. | 57/401 |

FOREIGN PATENT DOCUMENTS 0052412 5/1982 European Pat. Off. .

*Primary Examiner*—John Petrakes

*Attorney, Agent, or Firm*—Barnes & Thornburg

[57] ABSTRACT

An arrangement is disclosed for open-end friction spinning with two adjacently arranged friction rollers driven in the same rotational direction and forming a wedge-shaped yarn forming gap. The wedge-shaped gap is at least partially accessible for purposes of maintenance. A fiber inlet and opening device is provided which contains a fiber feed channel leading to the wedge-shaped gap. The fiber feed channel includes at least two component parts divided by a partitioning line extending in the feed channel longitudinal direction wherein one of the component parts is moveable with respect to the other portions of the channel for exposing the wedge-shaped gap at least in the fiber supply opening area of the fiber feed channel.

22 Claims, 11 Drawing Figures

Fig. 1
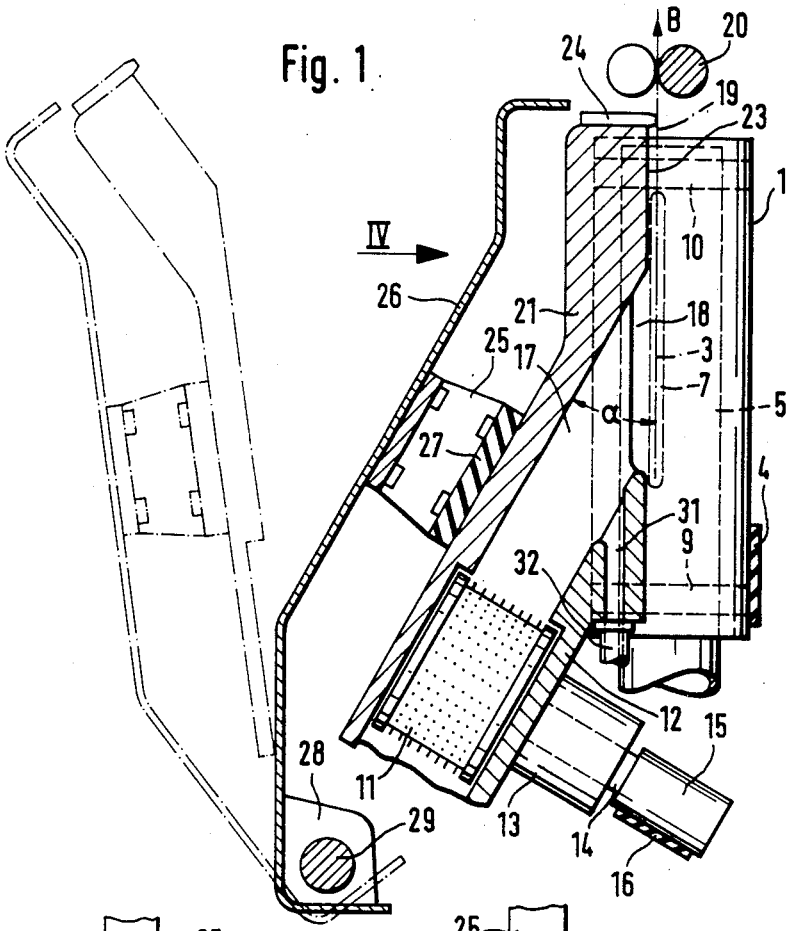
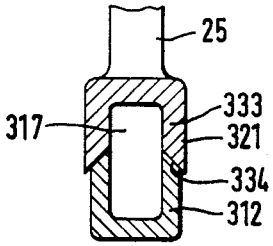
Fig. 3
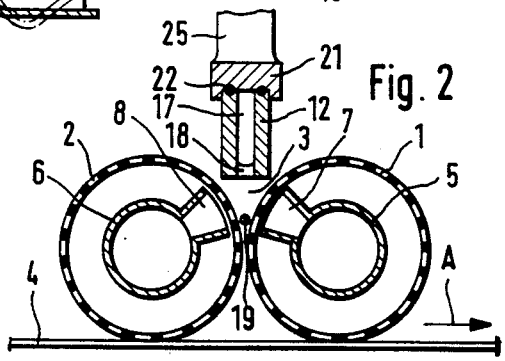
Fig. 2

Fig. 8
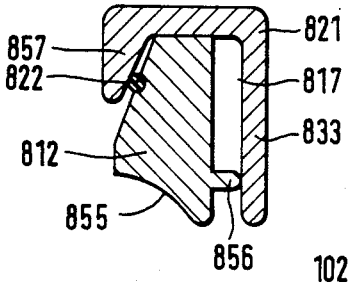
Fig. 9
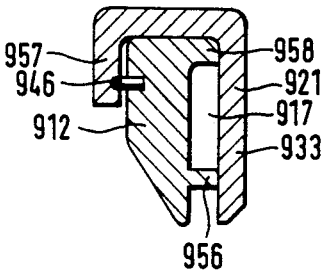
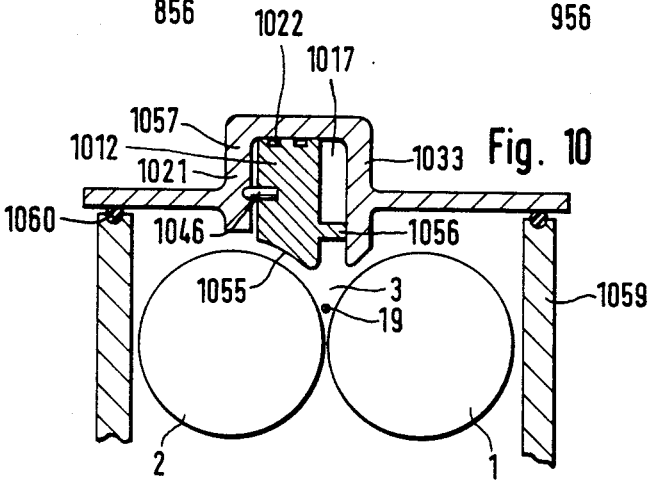
Fig. 10
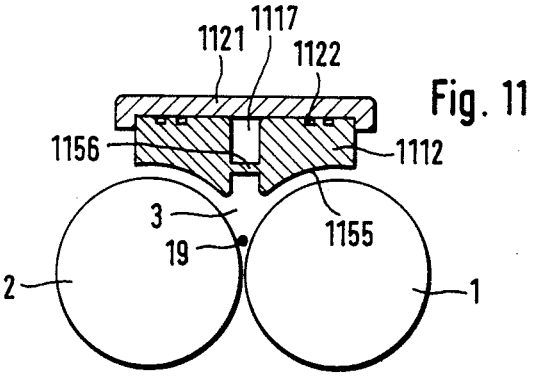
Fig. 11

FIBER FEED CHANNEL ARRANGEMENT FOR OPEN-END FRICTION SPINNING

BACKGROUND AND SUMMARY OF THE INVENTION

The invention relates to an arrangement for open-end friction spinning of the type with two adjacently arranged friction rollers driven in the same rotational direction and forming a wedge-shaped yarn forming gap which is at least partially accessable for purposes of maintenance, and with an inlet and opening device containing a fiber feed channel which opens in the area of the wedge-shaped gap.

With an arrangement for open-end friction spinning of the kind mentioned above such as described in European published unexamined application (EP-OS) No. 52 412, a fiber feed channel is arranged in a stationary housing. One of the two friction rollers which form the wedge-shaped gap is also stationarily arranged while the other roller is movably borne, whereby a swivel axis is provided at one end of the roller axle which swivel axis extends parallel to the plane defined by the two roller axles. The other end of this pivotable roller is guided in a slideway of a housing so that a precise return of the same is made possible while retaining the relative position. By outwardly pivoting the second roller, the wedge-shaped gap is made accessible in a limited manner for a maintenance process with this arrangement. With this complicated and expensive construction, however, the accessibility is only provided over and via the end faces of the rollers so that an eventually necessary cleaning process or the like becomes rather burdensome.

The invention is based upon the problem to construct an arrangement of the kind mentioned above in a simple manner so that the accessibility is improved for maintenance purposes, thereby increasing the servicing friendliness or servicability of the machine.

This problem is solved according to the invention by providing that the fiber feed channel includes at least two component parts divided by a partitioning line extending in the longitudinal direction to the channel, one of which component parts is movable away from the other component for exposing the wedge-shaped gap and at least the fiber feed opening area of the said channel.

With this construction according to the invention, the rollers which are arranged at close spacing and adjacently to each other need not be moved relative to one another during a maintenance process so that the tolerances necessary for dimensioning the wedge-shaped gap are more easily retained. In addition, however, the wedge-shaped gap, especially in the opening area of the fiber feed channel, is made accessible for a maintenance or servicing procedure so that this area can be very easily observed and eventually also cleaned. Furthermore, the fiber feed channel itself is exposed over at least a good portion of its entire length, making the servicing of the same possible. This is of special importance since greasy particles or even fibers may stick to the inner surfaces of the fiber feed channel during processing of natural fibers, whereby the spinning process may be greatly disturbed. The construction of the invention is altogether rather simple since only a relatively light component is being moved for the maintenance procedure.

According to a further feature of preferred embodiments of the invention it is provided that the movable component of the fiber feed channel is pivotably borne. It is thereby possible to readily remove this component out of the operational position, and return the same into its operational position without any additional adjustment. It is also suitable according to certain preferred embodiments to provide that the movable component of the fiber feed channel is retained in the operational position by means of a return spring. It is further advantageous to provide locking means for positioning and/or locking of parts into the operational position, which locking means are arranged at the movable component of the fiber feed channel and/or the other component. Higher tolerances are thereby permitted, especially for the bearing or guidance of the movable component, without unfavorably influencing the return of same to the exact operational position.

In order to avoid that fibers or the like are left behind in the area of the partitioning line between the fiber feed channel components, an advantageous feature of preferred embodiments of the invention is the provision of an atmospheric air gap remaining between the component parts of the fiber feed channel over a portion or the entire length of the partitioning line. Since the fiber feed channel is exposed to underpressure or subpressure, a small amount of air is then sucked in via the partitioning line gap, which air stream removes all fibers that would otherwise get caught therein.

In order to also expose other important parts of the fiber feed channel besides the wedge-shaped gap, a further feature of preferred embodiments of the invention is the provision that the movable component of the fiber feed channel forms at least one channel wall of the fiber feed channel having a rectangular cross section, which channel wall extends up to the opening or mouth of the fiber feed channel. By then removing this one part of the fiber feed channel, the feed channel is exposed in its entire cross section.

According to a further advantageous feature of certain preferred embodiments of the invention, the movable component of the fiber feed channel is provided with a projection means adjacent to the area of the fiber feed opening and covering the wedge shaped gap outside of the fiber feed opening area. This projection serves the purpose to prevent the infiltration of secondary or leaking air.

A further advantageous feature of preferred embodiments of the invention is the provision that the stationary component of the fiber feed channel is arranged at a housing surrounding an opening roller of the inlet and opening device. By attaching this stationary component of the fiber feed channel to the housing of the opening roller which is accomplished by, for example, a one part construction with the housing, a very precise positioning to the opening roller is necessarily achieved.

In certain preferred embodiments of the invention it is provided that the movable component of the fiber feed channel is retained at the lid covering the inlet and opening device as well as the friction rollers. Thereby, when the lid is opened the spinning unit is almost entirely exposed, together with the wedge-shaped gap, so that the areas of the inlet or supply roller, the opening roller, and the friction rollers forming the wedge-shaped gap can be observed, examined, and as necessary are accessible for a maintenance procedure.

According to certain other preferred embodiments of the invention it is provided that the movable component of the fiber feed channel is constructed as a lid covering the inlet and opening device and the rollers. The movable component part of the fiber feed channel is thereby assigned another function, namely the purpose of a cover. It can certainly also be provided according to embodiments contemplated by the invention that the cover is arranged as a closure for a housing surrounding the rollers.

Further objects, features, and advantages of the present invention will become more apparent from the following description when taken with the accompanying drawings which show, for purposes of illustration only, several embodiments in accordance with the present invention.

BRIEF DESCRIPTION OF THE DRAWINGS

FIG. 1 is a schematic partial cross sectional view through an arrangement for friction spinning, taken approximately through the plane of the wedge-shaped gap, and depicting a fiber feed channel constructed in accordance with a first preferred embodiment of the invention;

FIG. 2 is a schematic cross sectional view through the arrangement according to FIG. 1 in the area of the opening or mouth of the fiber feed channel;

FIG. 3 is a cross sectional view through a fiber feed channel in an area between an opening roller and its opening or mouth, showing another preferred embodiment of the fiber feed channel construction;

FIG. 8 is a schematic partial cross sectional view through a fiber feed channel in the area between an inlet and opening device and its fiber feed or opening, constructed in accordance with a preferred embodiment of the present invention;

FIG. 9 is a schematic partial cross sectional view similar to FIG. 8 through another embodiment of the invention;

FIG. 10 is a schematic cross sectional view similar to FIG. 2 through a spinning unit arrangement constructed in accordance with another embodiment of the invention with the movable component of the fiber feed channel serving as a lockable lid for a housing surrounding the friction rollers; and FIG. 11 is a schematic cross sectional view similar to FIGS. 2 and 10 showing another embodiment of the invention.

DETAILED DESCRIPTION OF THE DRAWINGS

Figure 4:
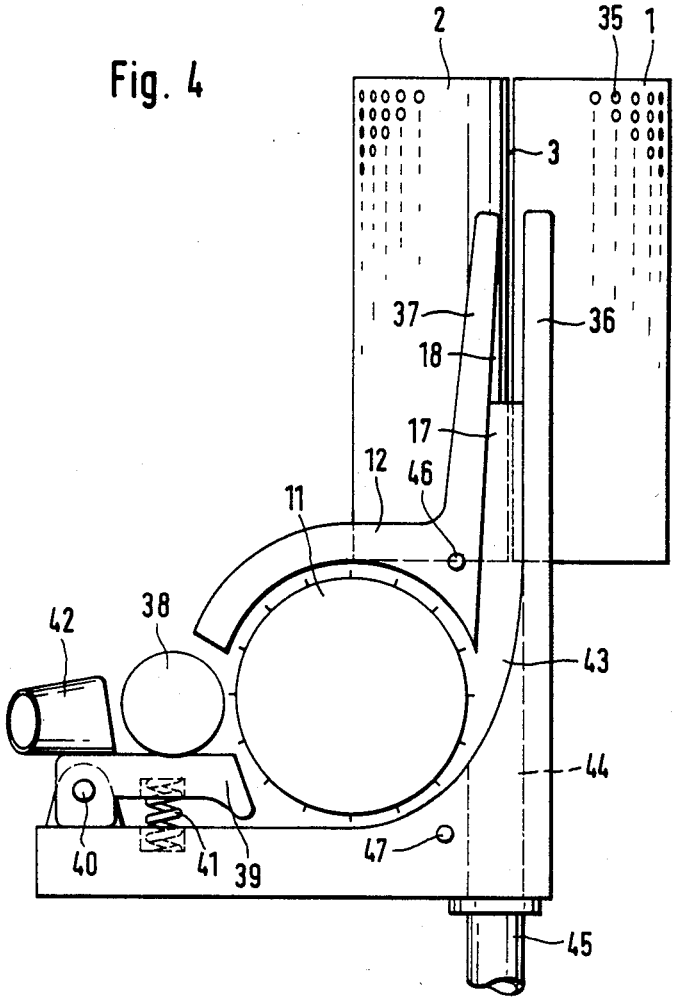
FIG. 4 is a frontal schematic view, taken in the direction IV of FIG. 1, with the cover and movable part of the fiber feed channel removed to illustrate the exposed wedge-shaped yarn forming gap formed by the fricton rollers.

A spinning machine for open end friction spinning includes a plurality of adjacently arranged spinning units of which only one spinning unit or one device respectively is shown in the drawings. In order not to obscure the invention, which is related to the fiber feed channel arrangement, only those portions of a spinning machine are shown and described as are deemed necessary for one skilled in the art to make and use the invention.

The arrangement according to FIGS. 1, 2 and 4 includes two adjacently arranged friction rollers 1 and 2 which together form a wedge-shaped gap 3 in which the yarn formation takes place. The two rollers 1 and 2 are driven by means of a tangential belt 4 which extends in the longitudinal direction of the machine and simultaneously drives the rollers 1 and 2 of all spinning units or at least a group of spinning units of one side of the machine. The tangential belt 4 thereby runs directly upon the outer surfaces of the coats of rollers 1 and 2, arranged adjacent to one another in the machine longitudinal direction.

The coats or mantles of rollers 1 and 2 are borne upon tubes or pipes 5 and 6 by means of roller bearings 9 and 10. Tubes 5, 6 are respectively closed at one end face and are connected with their other side end face to a not further illustrated subpressure or vacuum source. The tubes 5 and 6 are provided with suction slits 7 and 8 which are limited by generally radially extending protrusions disposed closely adjacent to the inside walls of the rollers 1 and 2, and are directed toward the area of the wedge-shaped gap 3. A suction air stream is thereby produced in the area of the wedge-shaped gap 3 for retaining not only the supplied fibers, but also the forming yarn 19, in the wedge-shaped gap.

Each spinning unit or arrangement includes an inlet and opening device for opening a fiber band or sliver being supplied into single fibers, which single fibers are then carried to the wedge-shaped gap 3. The fiber band is supplied via a feed hopper 42 to an inlet device (FIG. 4) which includes a driven inlet roller 38 and an inlet feed table 39 which is pressed against the inlet roller. The feed table 39 is pivotably borne about an axle extending parallel to the axis of feed roller 38 and is pressed against said roller 38 by means of a compression spring 41. The feed roller 38 and the feed table 39 offer the fiber band in the form of a fiber beard to an opening roller 11 which includes about its circumference a fitting of teeth or needles. The singled out fibers are further transported via a feed or inlet channel 17 which is disposed with a mouth or opening 18 so as to form a so called fiber dispersion zone opposite the wedge-shaped gap 3. The feed channel 17, which is flat and has a rectangular cross section, is disposed to extend essentially in the plane of the wedge-shaped gap 3 (in a plane through the wedge-shaped gap 3 which extends transverse to the plane containing the axles of both rollers 1 and 2). The feed channel 17 is inclined with respect to the wedge-shaped gap at an angle which advantageously is smaller than 45°. The axle 14 of the opening roller 11 is disposed in a plane extending transversely to the joint plane of both the axles of rollers 1 and 2. The inlet and opening device in its entirety is arranged below rollers 1 and 2. A yarn withdrawal device 20 is arranged above rollers 1 and 2 and includes a driven roller and a pressure roller by means of which the producing yarn 19 is drawn off in the direction of arrow B. The yarn 19 is subsequently wound about a take-up spool by a not further illustrated take-up or spooling arrangement.

The opening roller 11 is arranged within a housing 12 which exhibits a cylindrical projection 13 in which the axle 14 of the opening roller 11 is borne. The end of the axle protruding from the projection 13 is provided with a wharve 15 which is driven by a tangential belt 16. The tangential belt 16 extends in the machine longitudinal direction and drives all opening rollers 11 of all spinning units respectively at one machine side.

A channel 31 is provided in the housing 12 which opens up into the feed channel 17 at the feed channel side facing away from the yarn withdrawl device 20. Channel 31 advantageously extends parallel to the wedge-shaped gap 3 and is connected via a duct or lead 32 to a not further illustrated underpressure source. This channel 31 is connected to the underpressure source only during yarn piecing or start spinning operations to facilitate sucking the yarn end into channel 31.

An air channel 44 (FIG. 4) opens into the fiber feed channel 17 in the area of the connection to the opening roller 11, which channel 44 extends preferably in the transportation direction of the fiber feed channel 17. Air channel 44 is connected by means of a duct or a lead 45 to a not further illustrated air pressure source. The fiber transport within the fiber feed channel 17 is influenced by the supply of air through air channel 45.

In order to expose the wedge-shaped gap 3 for a maintenance procedure, the fiber feed channel 17 divided into two component parts in its longitudinal direction. A first fiber feed channel component part is either fixedly attached to the housing 12 of the opening roller or manufactuerd as a single part with the same, while the other fiber feed channel component part is constructed as a cover or lid-like component 21 which extends over the entire axial length of the fiber feed channel 17 and defines the channel wall opposite to the wedge-shaped gap 3. This cover of lid-like component 21 is furthermore provided with a projection 23 covering the outer end face of the opening roller 11. The component 21 includes this projection 23 which adjoins the area of the mouth or opening 18 in the yarn withdrawal direction B and which covers the wedge-shaped gap 3, as well as the adjacent facing top surface areas of the rollers 1 and 2 in order to here avoid the infiltration of secondary air. The projection 23 is provided at its end protruding over the end faces of rollers 1 and 2 with a thread or yarn carrier 24 which is arranged in such a manner that it positions the yarn 19 being produced in the wedge-shaped gap 3.

The lid-like or cover-like component 21 is fixedly attached to a pivotable cover 26 which itself is pivotably arranged at a holder or lever 28 for movement about an axle 29 extending underneath the inlet and opening device as indicated in dotted lines in FIG. 1. The mounting or fixation of the component 21 is done by means of a holder or rastener 25 which is screwed at the cover 26 and by means of a fastening element 27 which is elastically arranged between the component 21 and the fastener 25.

As can be seen espcailly from FIG. 2, the housing 12 has a U-shaped cross section in the area of the fiber feed channel 17 which is open to the outside and which is covered by the component 21 to form the flat, rectangular channel cross section. In order to prevent the infiltration of secondary air, especially in the area of the mouth or opening 18, sealing rings 22 are provided between the movable component 21 and the component of the fiber feed channel 17 formed by the housing 12. The movable component 21 includes groove-like recesses extending in the longitudinal direction of the fiber feed channel 17 by means of which recesses the component of the fiber feed channel 17 is encompassed thereby centering the same in the operational position. In order to additionally provide an exact centering for the operational position, other centering means are provided between the component 21 and the housing 12, namely fitting pins 46 and 47 (FIG. 4) which are arranged at the housing 12 and to which recesses are allocated in the component 21 having sloped inlet portions to guide the fitting pins to the operational closed position of the parts. At least one of the fitting pins 46 or 47 may also be utilized for the parts locking into the operational position, for example by providing the same with a ring band into which a spring or a spring-like cam or the like of component 21 is locked into.

By pivoting away the cover element 26 and thereby simultaneously the component 21, not only the outer surfaces of rollers 1 and 2 and the wedge-shaped gap 3 are exposed especially in the area of the opening 9 or mouth 18 of the fiber feed channel, but also the interior of the fiber feed channel 17 is exposed so that the same may be checked and if the need arises, also be cleaned. Additionally, by pivoting away the component 21, the channel 31 is exposed, the same being located in the stationary part of the fiber feed channel 17, so that a yarn end can be conveniently introduced into this channel 31 for a yarn piecing process. After the closing of the arrangement by pivoting back cover 26 together with component 21, the yarn end is then located in an area suitable for the yarn piecing process, namely in the interior of the spinning unit. By holding the yarn end within channel 31 during the yarn piecing process, a yarn end available for yarn piecing is produced in the area of the opening or mouth 18 of the fiber feed channel 17. Rollers 1 and 2 rotating in operational direction inflict a false twisting upon the yarn end so held, due to a friction effect which is unilaterlly directed against the earlier inflicted spin twisting so that the yarn end is opened and separated at this portion. This opened yarn end is especially suitable for a yarn piecing process connecting same with newly supplied fibers.

FIG. 3 is a cross sectional view taken transversely with respect to the longitudinal direction of a fiber feed channel 317 constructed in accordance with another preferred embodiment. The partitioning wall with this fiber feed channel 317 arrangement extends about in the center of the channel resulting in two, U-shaped component parts 312 and 321, wherein component part 321 is connected via a holder or fastener with a not further illustrated cover in a manner described above for fastener 25 and cover 26 of the FIG. 1 embodiment. The partitioning lines positioned in the channel side walls 333 are formed by surfaces 334 and extend at an angle of about 45°, whereby the surfaces 334 of the movable component 321 overlap the partitioning surfaces 334 of the stationary component 312. An improved centering effect, as well as a good sealing between the two components 312 and 321 is obtained by utilizing the sloped surfaces 334.

Figure 5:
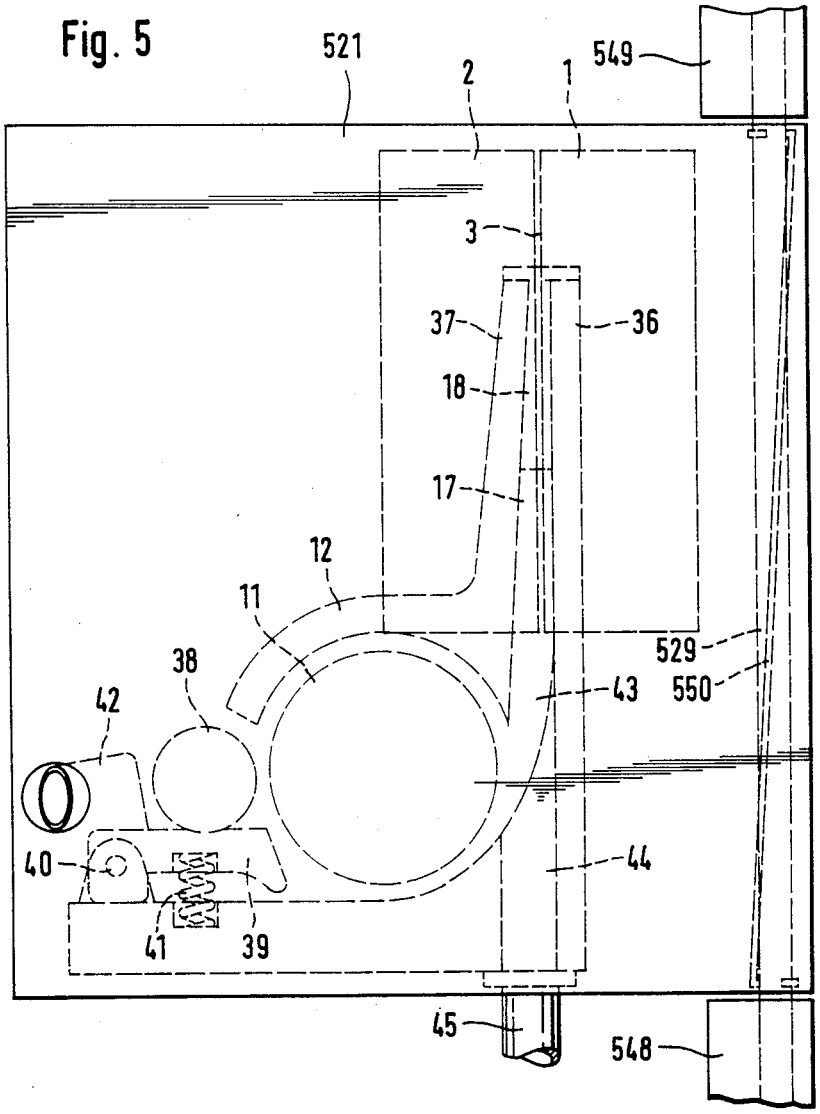
FIG. 5 is a view similar to FIG. 4, showing another embodiment of the invention with the movable component part of the fiber feed channel arranged at a lid pivotable about a vertical axis and covering the entire spinning unit, the parts under the lid being depicted in dashed lines.

The embodiment according to FIG. 5 corresponds in its basic structure to FIGS. 1, 2 and 4. A movable component 521 is here provided instead of a component 21 attached to a cover 26, which component 521 covers lid-like the fiber feed channel and the opening roller and which is at the same time also designed as a cover for the other parts of the inlet and opening device, as well as for the rollers 1 and 2. This component 521 is pivotably arranged between two fastening means 548 and 549 of the machine frame about a vertical axle 529. A torsion spring 550 is provided in the area of the axle 529 which serves as a return spring and retains the component 521 in the operational position, or returns the same to the operational position after an opening of the machine.

Figure 6:
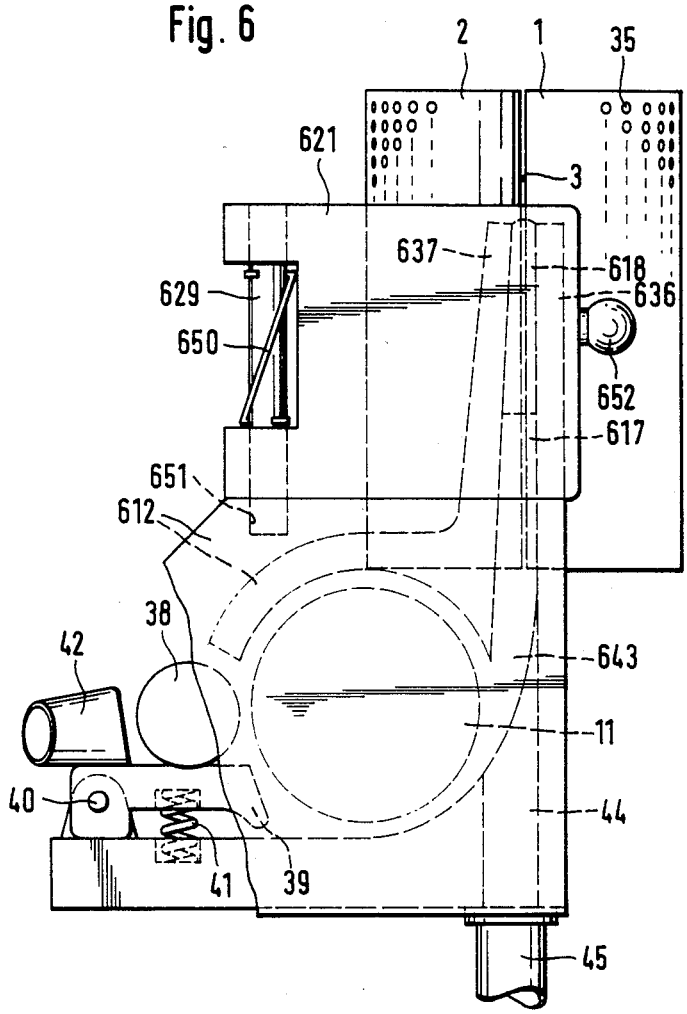
FIG. 6 is a view similar to FIGS. 4 and 5 showing another embodiment of the invention with the movable component of the fiber feed channel being arranged on a pivot axle at a housing for the opening roller.

With the embodiment according to FIG. 6 which in its basic structure corresponds also to the embodiment according to FIGS. 1, 2 and 4, the housing 612 for the opening roller 11 is provided with its own cover which is independent from a cover forming a component 621 of the fiber feed channel 617. The fiber feed channel 617 includes a channel entrance or opening 643 which is circumferentially closed and extends from the opening roller 11 up to about one-third of the entire length of the fiber feed channel 617. The cover component 621 connects thereto, forming a partitioning line extending in the longitudinal direction of the fiber feed channel 617 with respect to the housing 612 formed by one part of the fiber feed channel 617. This component 621 extends up to the area of the opening or mouth 618 and even further above same. The mouth 618 is located at the surfaces 636 and 637 of the housing 612. The lid-like component 621 is provided with an operating lever 652 and is pivotable about a swivel axle 629 extending parallel to the axes of rollers 1 and 2, which swivel axle 629 is set into a seat or receiver 651 of the housing 612. A torsion spring 650 is arranged as a return spring in the area of the axle 629 between the same and the lid-like component 621.

Figure 7:
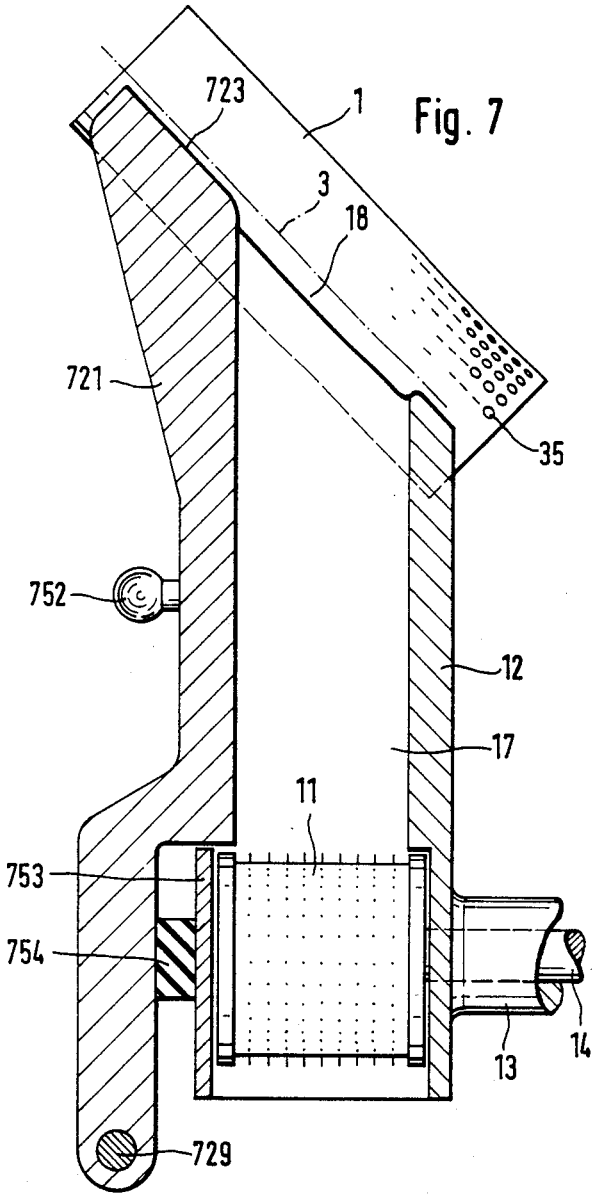
FIG. 7 is a schematic partial cross sectional view similar to FIG. 1, showing a further embodiment of the invention with a movable component of the fiber feed channel serving as a cover for the spinning unit and being in the form of a lid.

With the embodiment according to FIG. 7, the fiber feed channel 17 is composed of a stationary component formed by the housing 12 of the opening roller 11 and by the component 721 which is arranged as a pivotable cover or lid. Component 721 extends over the entire length of the fiber feed channel 17. A partitioning line extending in the longitudinal direction of the fiber feed channel 17 defines the separation of component 721 and the stationary component 12. The lid-like component 721 has an operating lever 752 and is pivotable about a swivel axle 729 located underneath the opening roller 11. An opening roller housing cover 753 is fixedly attached via a rubber elastic fastening element 754 to the component part 721 and covers the end face of the opening roller 11. The lid-like component 721 is moreover provided with a fitting strip 723 which covers the area of the wedge-shaped gap 3 following the opening or mouth 18 in the yarn withdrawal direction.

The embodiments according to FIGS. 8 through 11 are various forms of fiber feed channel construction which can interchangeably be chosen in connection with the embodiments according to FIGS. 1, 5, 6, or 7; meaning that the movable components are attached to a cover 26 (FIG. 1), or themselves form the cover of a spinning unit (FIGS. 5 and 7), or only describe a component covering the area of the mouth or opening of a fiber feed channel (FIG. 6).

With the embodiment according to FIG. 8, the movable component 821 not only forms the channel wall opposite the wedge-shaped gap, but also one of the side walls 833 so that the stationary component 812 as well as the movable component 821 respectively form two side walls of the fiber feed channel 817. The stationary component 812 exhibits a profile with the side facing a roller 1 or 2 provided with a rounding off 855 adjusted to the diameter of the roller. This profile forms one of the side walls of the fiber feed channel 817 and the channel bottom by means of a cross-bar 856 which extends in longitudinal direction of the fiber feed channel 817. The movable component 821 includes an almost U-shaped cross section with which it encompasses the profile of the stationary component 812. It thereby leans against the cross bar 856 of the sides forming the side wall 833. An elastic sealing profile 822 is arranged between the other side 857 and the stationary component 812 which form inclined surfaces extending in the direction of the relative motion of the parts. The sealing profile 822, during the return of the component 821 to the here shown operational position, exhibits a force which sealingly presses the side of the component part 821 forming the channel wall 833 tightly against the cross bar 856. The fiber feed opening at the wedge-shaped gap is formed by an interruption in the cross bar 856.

With the embodiment according to FIG. 9, which is a modification of the general arrangement of FIG. 8, the component 912 arranged as a profile member includes a cross bar 958 which is disposed opposite the cross bar 956 facing the rollers, so that this component 912 forms three walls of a fiber feed channel 917 having a rectangular cross section. The movable component 921 only forms one channel side wall 933. This component 921 also exhibits a U-shaped cross section and encompasses the component part 912 arranged as profile. A catch element 946 is provided between the free side 957 of the component 921 and the component 912, for example, a catch bolt or stop bolt which locks into a recess of the component 921 and secures the operational position. The effective direction of this catch or stop bolt is transversely to the channel side wall 933 so that the same is securely pressed against the two cross bars 956 and 958. The fiber feed opening is iormed by an interruption in cross bar 956.

With the embodiment according to FIG. 10, the two friction rollers 1 and 2 are surrounded by a housing 1059. This housing 1059 is closed by means of a movable component 1021, which at the same time is a component part of the fiber feed channel 1017. Between this component 1021 serving as housing cover for the housing 1059 and this housing 1059, a sealing profile 1060 is arranged. The component 1021 includes a protrusion extending in the direction of the fiber feed channel 1017 and having a U-shaped cross section, which with its recess surrounds the stationary component 1012 arranged as a profile for the fiber feed channel 1017. The component 1012 forms one of the channel side walls and a longitudinal wall by means of a bar 1056. The movable component 1021 also forms a side wall 1033 and the channel longitudinal wall facing away from the wedge-shaped gap 3. A catch connection is provided between the free side of the movable component 1021 and the stationary component, for example, a spring-like retained catch bolt 1046 which resiliently locks into a recess of the movable component 1021 and thereby secures the same in operational position. A secure seat of the channel side wall 1033 against the cross bar 1056 is here also assured by means of the spring effect. Longitudinal grooves 1022 are arranged at the stationary component 1012 formed as a profile for the sealing of the fiber feed channel 1017, which grooves form a kind of labyrinth sealing with the opposite surface of the movable component 1021. Again the fiber feed opening is formed by an interruption in the cross bar 1056.

With the embodiment according to FIG. 11, the stationary component 1112 exhibits the shape of two profiles extending in the longitudinal direction of rollers 1 and 2, which each are located opposite the rollers with surfaces 1155 conforming to the contours of rollers 1 and 2 and which are connected to each other by means of a cross bar 1156 forming the channel wall facing the wedge-shaped gap 3. A cover-like movable component 1121 is provided for the completion of the fiber feed channel 1117 which attaches to the two profiles by means of sideway fitting strips. Both profiles are provided with longitudinal grooves 1122 for forming a labyrinth sealing. Interruption of cross bar 1156 forms the fiber feed opening of the wedge-shaped gap 3.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. Arrangement for open-end friction spinning comprising:

drivable friction surface means defining a yarn formation zone, and fiber feed means including a fiber feed channel means having a fiber feed opening facing the yarn formation zone and defining a fiber distribution zone in said yarn formation zone, wherein the fiber feed channel means includes at least two channel component parts divided by a partitioning line extending in the channel longitudinal direction, one of which channel component parts is movable with respect to the at least one other channel component part to facilitate access to the yarn formation zone and at least the fiber feed opening area of the fiber feed channel.

2. Arrangement according to claim 1, comprising pivot support means for pivotally supporting the moveable channel component part.

3. Arrangement according to claim 2, wherein return spring means are provided for retaining the moveable channel component part in its operational position.

4. Arrangement according to claim 1 wherein return spring means are provided for retaining the moveable channel component part in its operational position.

5. Arrangement according to claim 1, further comprising adjusting means for adjusting and/or locking the movable channel component part in its operational position with respect to the at least one other channel component parts.

6. Arrangement according to claim 5, wherein said adjusting means are arranged at at least one of the moveable channel component part and the at least one other channel component parts.

7. Arrangement according to claim 1, wherein an air gap connected to the atmosphere is retained over a part or the entire length bf the partitioning line between the component channel parts.

8. Arrangement according to claim 1, wherein the fiber feed channel means exhibits a rectangular cross section, and wherein the moveable channel component part forms at least one channel wall extending to the fiber feed opening area of the fiber feed channel means.

9. Arrangement according to claim 1, wherein the moveable channel component part is provided with a catch or fitting strip following the area of the fiber feed opening and outside of said fiber feed opening.

10. Arrangement according to claim 1, wherein the fiber feed channel means is constructed in two parts including a single stationary channel component part and said movable channel component part, and wherein the stationary component part is arranged at a housing surrounding an opening roller.

11. Arrangement according to claim 10, wherein the moveable channel component part is retained at the housing surrounding the opening roller and is provided with a swivel axle.

12. Arrangement according to claim 11, wherein the swivel axle extends parallel to the yarn formation zone.

13. Arrangement according to claim 1, wherein the moveable channel component part is retained at a cover covering a fiber inlet and opening device and the friction surface means.

14. Arrangement according to claim 13, wherein the cover is supported for pivotal movement about an axle extending perpendicularly to the yarn formation zone.

15. Arrangement according to claim 14, wherein the moveable channel component part is fixedly attached to the cover by means of a spring-elastic fastening means.

16. Arrangement according to claim 1, wherein the moveable channel component part is designed as a cover element covering the inlet and opening device and the friction surface means.

17. Arrangement according to claim 1, wherein the movable channel part includes a cover constructed as a closure for a housing surrounding the friction surface means.

18. Arrangement according to claim 17, wherein a housing cover for an opening roller is arranged at the cover, preferably via a spring-elastic fastening element.

19. Arrangement according to claim 1, wherein the moveable channel component part exhibits a U-shaped cross section and at least partially surrounds the at least one stationary channel component part when in the operational position.

20. Arrangement according to claim 1, wherein said movable channel part adjoins the housing for an opening roller by means of a vertically extending pivot axle.

21. An arrangement according to claim 1, wherein the drivable friction surface means comprises a pair of adjacently arranged friction rollers drivable in the same rotational direction and the yarn formation zone comprises a wedge-shaped gap between the rollers.

22. Arrangement according to claim 21, wherein the fiber feed channel means extends in the plane of the wedge-shaped gap and at an angle to the common plane of the axes of the friction rollers, and wherein the moveable channel part forms at least one of a channel wall opposite the wedge-shaped gap and a side channel wall.

* * * * *